US009982400B1

(12) United States Patent
Davis et al.

(10) Patent No.: US 9,982,400 B1
(45) Date of Patent: May 29, 2018

(54) REMOTE CONTROL LEVELER BRUSH FOR ROAD CONSTRUCTION

(71) Applicant: GreensGroomer WorldWide, Inc., Indianapolis, IN (US)

(72) Inventors: Michael E. Davis, Indianapolis, IN (US); James Richard Hanson, Ft. Wayne, IN (US)

(73) Assignee: GreensGroomer WorldWide Inc., Indianapolis, IN (US)

( * ) Notice: Subject to any disclaimer, the term of this patent is extended or adjusted under 35 U.S.C. 154(b) by 0 days. days.

(21) Appl. No.: 15/626,456

(22) Filed: Jun. 19, 2017

(51) Int. Cl.
*E01C 19/42* (2006.01)
*E02F 3/76* (2006.01)
*E02F 3/815* (2006.01)

(52) U.S. Cl.
CPC ..... *E01C 19/42* (2013.01); *E02F 3/7663* (2013.01); *E02F 3/815* (2013.01)

(58) Field of Classification Search
CPC ..... E01C 19/42; E02F 3/7663; E02F 3/815
USPC ..... 404/101, 108, 110
See application file for complete search history.

(56) References Cited

U.S. PATENT DOCUMENTS

| | | | | |
|---|---|---|---|---|
| 2,142,262 | A | 1/1939 | Beckham et al. | |
| 2,184,913 | A | 12/1939 | Fuller | |
| 4,917,533 | A * | 4/1990 | Wilson | E01C 11/005 118/108 |
| 5,362,178 | A * | 11/1994 | Schantz | E01C 19/16 222/167 |
| 5,833,013 | A | 11/1998 | Davis | |
| 6,102,615 | A * | 8/2000 | Wilson, Sr. | E01C 19/16 118/108 |
| 6,655,469 | B1 | 12/2003 | Davis | |
| 8,220,558 | B2 | 7/2012 | Davis | |
| 9,179,588 | B2 | 11/2015 | Davis et al. | |
| 9,668,397 | B2 | 6/2017 | Davis | |
| 2010/0158608 | A1 * | 6/2010 | Wilson, Sr. | C04B 24/2641 404/75 |
| 2017/0328028 | A1 * | 11/2017 | Chern | E02F 3/7663 |

* cited by examiner

*Primary Examiner* — Raymond W Addie
(74) *Attorney, Agent, or Firm* — Woodard, Emhardt, Moriarty, McNett & Henry LLP

(57) ABSTRACT

A device movable across a road to level emulsion thereon. A wheeled frame includes brushes extending downward to engage the emulsion. A manual worm gear connected between the frame and a towbar assembly positions the towbar mount to connect to a vehicle hitch and vertically moves the frame while maintaining the brush contacting plane. A linear actuator along with side plane adjusters position the brushes to contact the road surface even though the surface is uneven.

20 Claims, 6 Drawing Sheets

REMOTE CONTROL LEVELER BRUSH FOR ROAD CONSTRUCTION

BACKGROUND OF THE INVENTION

Field of the Invention

The present invention relates generally to the field of vehicles or carriers movable across roads for the working of the upper surface thereof.

Description of the Prior Art

The maintenance of old asphalt roads can include spraying an emulsion on the top surface of the road. Aggregate may then be dropped onto the emulsion with the aggregate sinking below the top surface of the emulsion. Asphalt roads particularly those in the rural area may not be adequately maintained thereby increasing the deteriation.

A crown may run along the center of the road providing higher elevation in the middle as contrasted to the sides of the road. Further, the road may be undulating and uneven across the width and length thereof. Nevertheless, the emulsion must be evenly applied resulting in a smooth surface. The emulsion could be spread across the road either manually by brushes, scrapers or other devices. Alternatively, a frame with scrapers extending downwardly may be pulled behind a truck in order to attempt to achieve an even surface. It becomes difficult to achieve an even surface due to the varying elevation and deteriation of the road. Disclosed herein is a wheeled frame pullable behind a truck or other vehicle with the frame having downwardly extending brushes that are initially adjusted relative to the road surface as well as being adjusted as the frame is pulled along the road to ensure the brushes contact the emulsion in such a manner to achieve an even top surface. Substantial savings are achieved using the above technique since the life of the road is prolonged and therefore not requiring construction of a new road.

In our U.S. Pat. No. 9,179,588 we disclose a towable vehicle having downwardly extending brushes for brushing top dressing material between grass blades for the proper maintenance of golf greens. A variety of different brush patterns extending down from the vehicle are disclosed. The U.S. Pat. Nos. 5,833,013; 6,655,469; 8,220,558; and 9,668,397 granted to the co-inventor Michael E. Davis also disclose various vehicles or frames movable across the ground having ground engaging elements.

Early road working machines were disclosed in the U.S. Pat. Nos. 2,142,262 WK Beckham et al. and 2,184,913 CG Fuller. Both patents disclose leveling blades or scrapers extending downwardly from a frame to engage the road.

The main disadvantage of the prior devices is the inability to easily and quickly adjust the devices extending downwardly to contact the emulsion as the road undulates and may result in a very uneven upwardly extending road surface. The device disclosed herein allows for an initial setting and continued adjustment of the positioning of the downwardly extending brushes depending upon the contour of the road surface. Further, the brush frame elevation may be remotely controlled by a transmitter/receiver combination.

The brush frame includes a towbar pivotally mounted thereto that is connectable to the pulling vehicle hitch. The hitch may vary in height from each vehicle to each vehicle. A mechanism is provided to position the towbar onto the hitch while maintaining the set plane of the brush frame.

Typically road working machines are transported to the working site by a flatbed vehicle. As the frame of the road working machine is pulled upwardly to store on a flat bed, the frame is traditionally tilted causing the rear portion of the frame to contact the ground with other portions of the frame contacting the top edge of the ramp as it is pulled onto the bed. The mechanism allows the brush frame to extend horizontally while the device is pulled from ground level up the ramp eliminating the prior problem of contact between the frame and the ground and/or the top of the ramp.

SUMMARY OF THE INVENTION

One embodiment of the present invention is a device for spreading and leveling emulsion applied to a road surface and comprising a frame having a longitudinal axis of movement. A towbar is pivotally mounted to the forward portion of the frame. Wheels are mounted to the frame with the axis extending therebetween. Brushes are mounted to the frame and extend transversely across the axis of movement and extend downwardly to spread and level the emulsion applied to the road surface. A first mechanism is connected to the towbar and the frame to pivot the towbar relative to the frame. A source of electrical energy is mounted on the frame. A second mechanism is mounted on the frame and is operatively connected to the source of electrical energy. The second mechanism is connected to the wheels for moving the wheels up and down relative to the frame and positions the brushes relative to the road surface.

It is an object of the present invention to provide a device for spreading and leveling emulsion applied to a road surface.

A further object of the present invention is to provide a new and improved road working device.

Yet a further object of the present invention is to provide a brush frame for leveling and spreading materials atop the ground.

Related object and advantages of the present invention will be apparent from the following description.

DESCRIPTION OF THE PREFERRED EMBODIMENT

Figure 1:
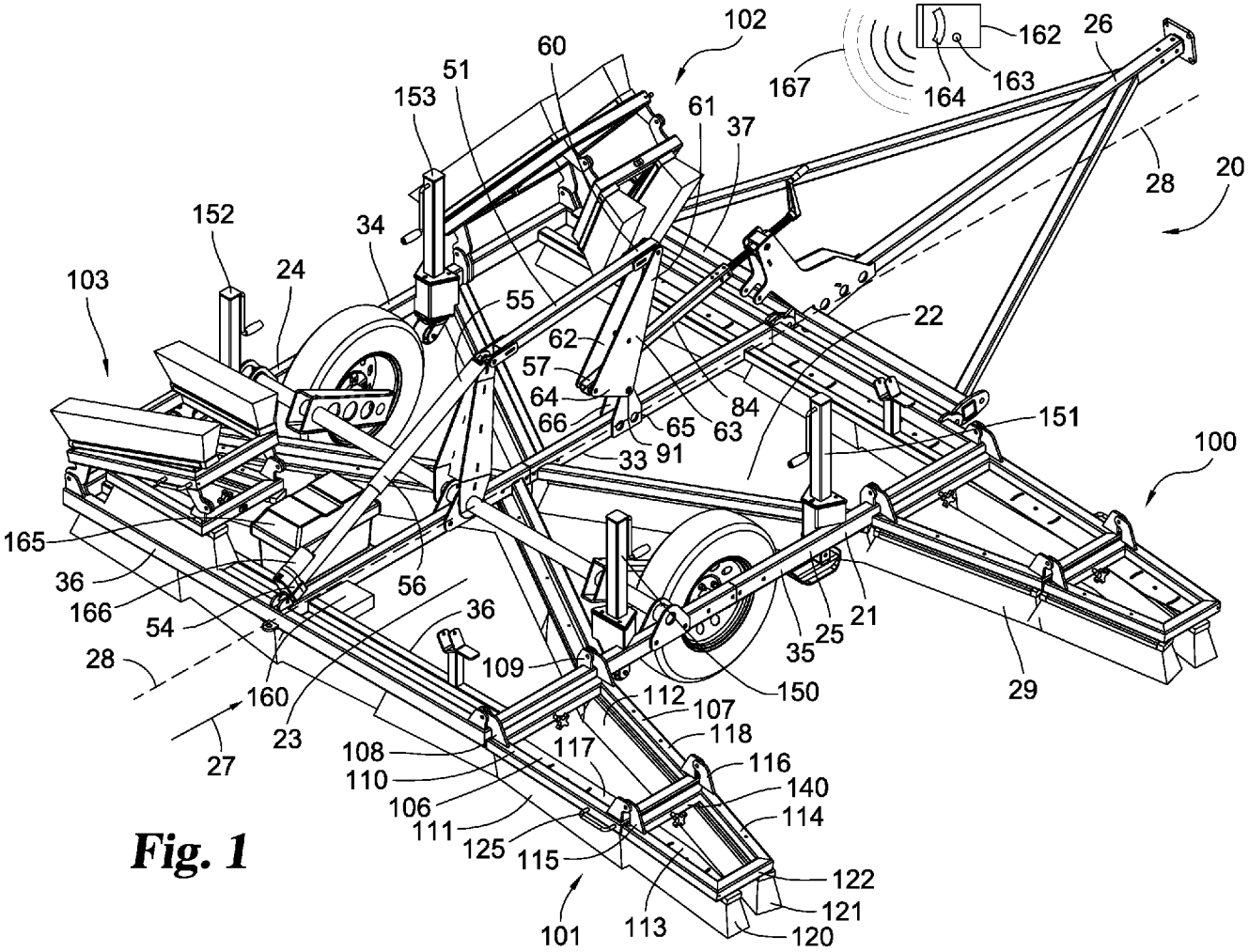
FIG. 1 is a rear perspective view of the spreading and leveling device incorporating the present invention with some of the brushes of the device mounted to wings being folded upwardly to a stored position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
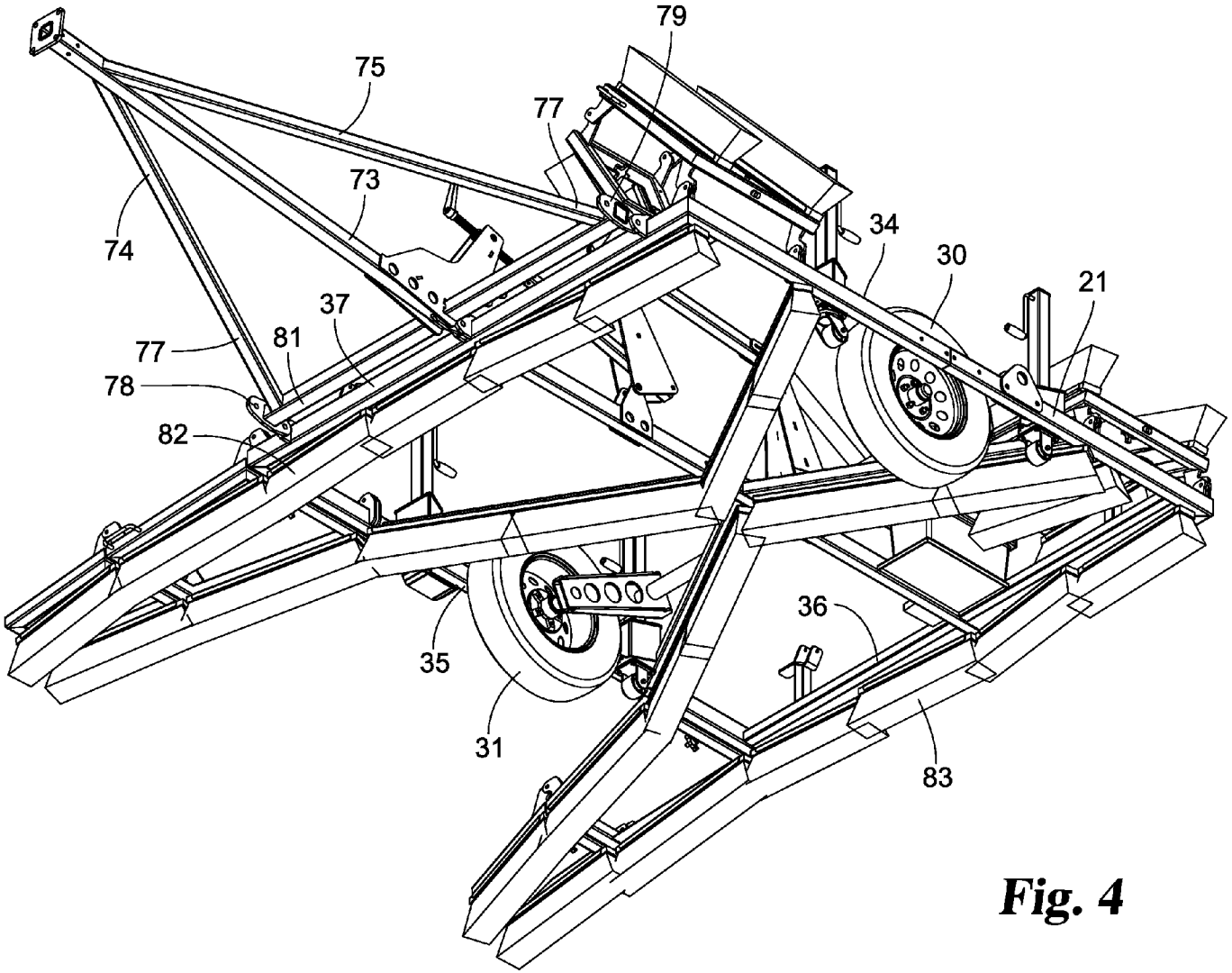
FIG. 4 is a bottom perspective view showing the upward stored brushes and downward in use brushes depending from the brush frame.

Referring to FIG. 1, a device 20 is shown for spreading and leveling emulsion applied to a road surface with the device including a rectangular frame 21 having a front portion 22 and back portion 23 along with a pair of parallel sides 24 and 25. Frame 21 includes side rails 34 (FIGS. 4) and 35 having opposite ends attached to front rail assembly 37 and rear rail assembly 36 forming the rectangular configuration of the frame.

A towbar assembly 26 is pivotally mounted to the front end portion 22 of the frame to enable the towbar to be connected to a truck or other vehicle and pulled in the direction of arrow 27 (FIG. 2) along the longitudinal central axis of movement 28 (FIG. 1). The towbar is pivotable to position its distal end between a position higher than frame 21 to a position lower than frame 21.

A plurality of brushes 29 extends downwardly from the frame to engage the emulsion atop the load surface. The brushes extend transversely across axis 28 and spread and level the emulsion as the frame is moved forward. The brushes mounted to and beneath the front rail 37 and rear rail 36 extend perpendicularly to axis 28 whereas some of the remaining brushes extend from one diagonal corner of frame toward the opposite diagonal corner of frame 21.

Wheels 30 and 31 (Fig.2) are rotatably mounted to brackets, in turn, fixedly secured to an axle 32 rotatably mounted to the centrally extending frame number 33 having its opposite ends connected to the frame. The wheels may be pivoted downwardly to support the frame thereby spacing the brushes apart from the road surface facilitating transportation of the device by another vehicle. Likewise, the wheels can be moved upwardly to not contact the road surface thereby allowing the bottom ends of the brushes to contact the emulsion atop the road surface.

Figure 2:
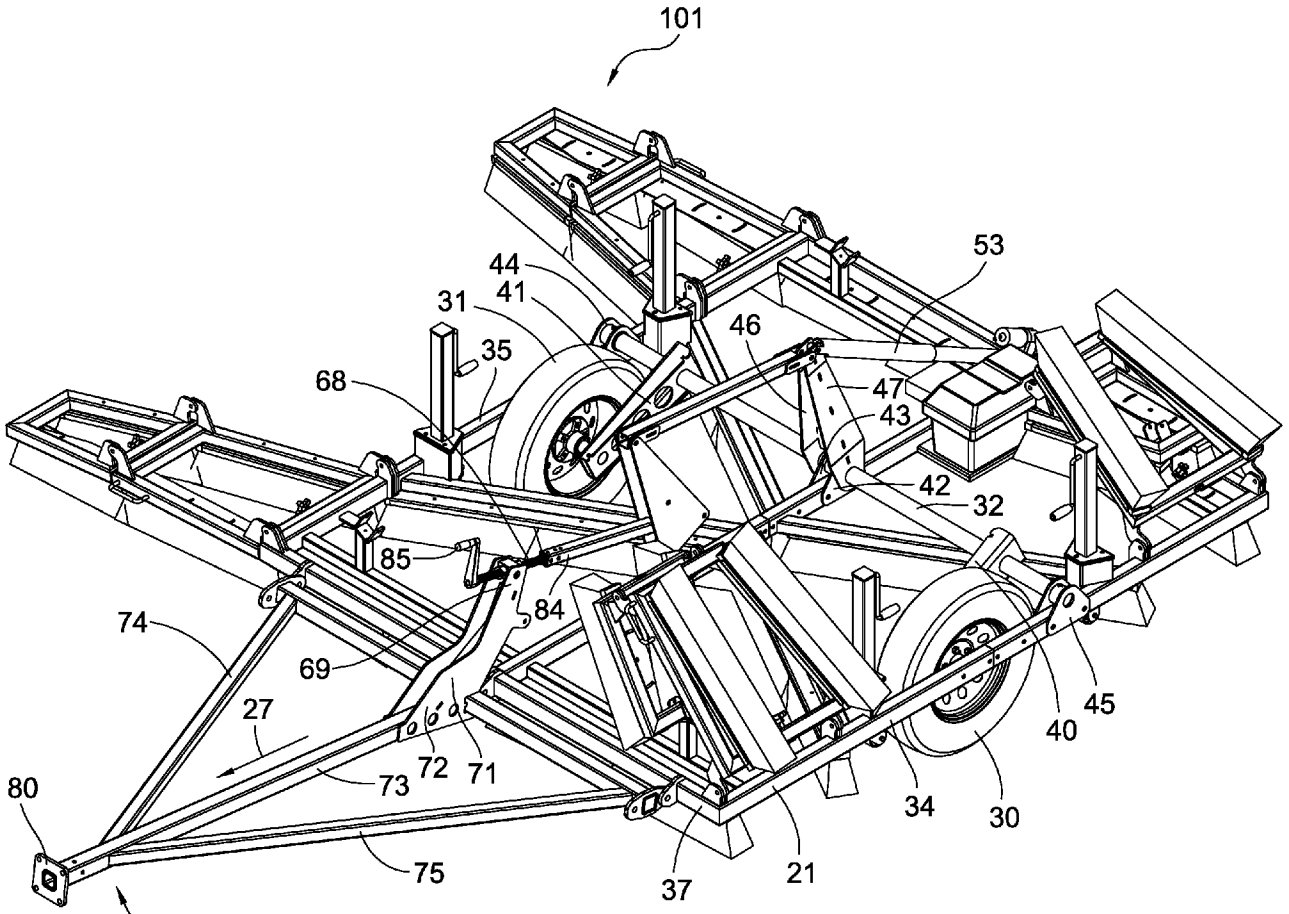
FIG. 2 is a front perspective view of the device of FIG. 1.

Wheels 30 and 31 are rotatably mounted respectively to members 40 and 41 (FIG. 2). Members 40 and 41 are, in turn, fixedly mounted to axle 32, in turn, rotatably mounted to a pair of brackets 42 and 43 fixedly secured central rail 33, in turn, having its opposite ends fixedly mounted to front rail 37 and rear rail 36 (FIG. 1). Members 40 and 41 rotatably receive the wheels which are offset with respect to the axis of rotation of axle 32. The opposite ends of axle 32 (FIG. 2) are rotatably mounted by brackets 44 and 45 respectively to side rails 35 and 34. Further, axle 32 extends through and is rotatably mounted to brackets 42 and 43 fixedly mounted to the center rail 33.

Spaced apart members 46 and 47 have bottom ends fixedly mounted to axle 32 and move when axle 32 rotates thereby pivoting members 46 and 47 about their bottom ends. The top ends of members 46 and 47 are fixedly secured together and, in turn, are pivotally secured to rearward portion of cross link 51 (Fig.1). Thus, forward movement of cross link 51 in the direction of arrow 27 causes counterclockwise rotation of the axle and members 46 and 47, as viewed in FIG. 2, about the longitudinal axis of axle 32. Counterclockwise movement of members 46 and 47 thereby cause members 41 and 40 to pivot downwardly moving the wheels below the frame and brushes depending therefrom supporting the brush frame above the ground and preventing any contact between the brushes and the top surface of the road surface or ground.

A linear actuator 53 (FIG. 2) has a bottom end 54 (FIG. 1) pivotally mounted to rear rail assembly 36 and a top end 55 pivotally mounted to the junction connection of the top ends of members 46 and 47 to cross link 51. Linear actuators are well known in the industry and may include an electric motor for driving a worm gear within the casing of the actuator thereby causing the extension or retraction of the telescopically constructed casing. By actuating linear actuator 53, the casing 56 (FIG. 1) can be extended thereby causing members 46 and 47 to rotate in a clockwise direction, as viewed in FIG. 1, also causing clockwise rotation of axle 32 with the result wheels 30 and 31 pivoting to the downward position. In reverse, the linear actuator can be activated to shorten the length of casing 56 through the operation of the worm gear thereby causing members 46 and 47 to rotate in a counterclockwise direction as viewed in FIG. 1 causing counterclockwise direction of axle 32 and movement of wheels 30 and 31 to the upward stored position.

In order to provide for continuous adjustment of the brush contact with the emulsion atop the road, a commercially available receiver/transmitter combination is provided to remotely control the linear actuator. For example, a receiver 160 (FIG. 1) is mounted atop frame 21 and is connected to the motor 166 of the actuator. A 12 VDC transmitter 162 (FIG. 1) is located remotely from frame 21 and may be located in the vehicle pulling the frame 21 or carried by an operator walking beside the frame. The transmitter may be provided with an on/off switch 163 along with a switch 164 to control a signal 167 to the receiver for control of the rotation of the worm gear in the actuator. Examples of receiver/transmitter combinations are available from Ama-Max (USA) located at 10700 Kinghurst St, Houston, Tex. 77099 under model iMBAPrice 12V, 15 Amps, Heavy Duty Boat and Car Universal Remote Control Kit or from PRI Industries, Inc. located at 714 Vandustrial Dr, Westmont, Ill. 60559 under model 20 AMP Heavy Duty 12 Volt on/off Wireless Remote Control Switch. Other receiver/transmitters are commercially available. A battery is contained in battery housing 165 mounted to frame and is electrically connected to the actuator and receiver.

The forward end 60 (Fig. 1) of cross link 51 is pivotally attached to the top ends 61 of upwardly extending members 62 and 63 having bottom ends pivotally mounted to a pair of brackets 65 and 66, in turn, fixedly secured to the center rail 33.

A manually operated worm gear 68 (FIG. 2) has a threaded shaft threaded received by the top end 69 of spaced apart brackets 71 having bottom ends 72 fixedly secured to the center rail 73 of towbar assembly 26. The forward end of the threaded shaft has a crank handle 85 thereon to facilitate rotation of the worm gear threadedly received by casing 84 having its opposite casing end 57 (FIG. 1) pivotally mounted to the bottom corners 64 of brackets 62 and 63. Corners 64 are located closer to the rear portion 23 of the frame as compared to the forward corner portion 91 of brackets 62 and 63. Thus, rotation of worm gear 68 causes the casing 84 to be extended or retracted relative to the crank handle 75. Rotation of worm gear in one direction results in extension of casing 74, with brackets 62 and 63 rotating in a counterclockwise direction about pivot forward corner 91 as viewed in FIG. 1 whereas rotation of the crank handle in the opposite direction causes movement of casing 84 in a direction toward crank handle 85 causing clockwise movement of bracket 62 and 64 as viewed in FIG. 1. When bracket 62 and 63 are rotated in a clockwise direction as viewed in FIG. 1, the top ends of brackets 62 and 63 cause cross link 51 to move forward in a forward direction (arrow 27) thereby also causing rotation of brackets 46 and 47 in a clockwise direction.

Figure 3:
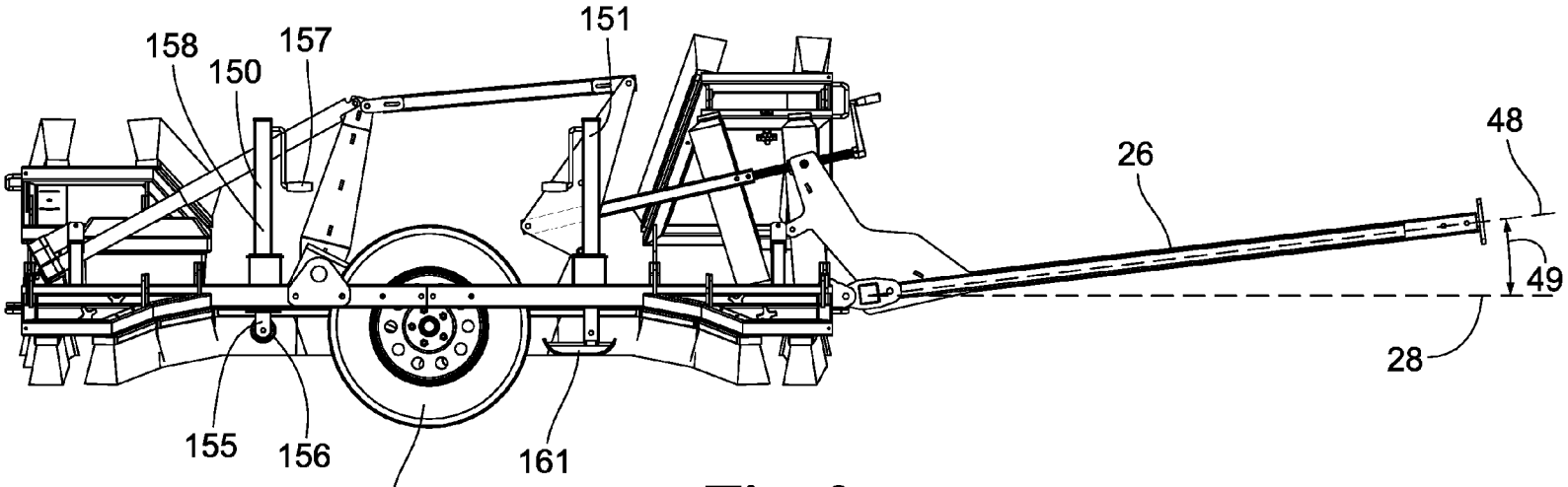
FIG. 3 is a side view of the device of FIG. 1 with the main wheels located in the road engaging position.

Towbar assembly 26 includes a central rail 73 (FIG. 4) bisecting the junction of rails 74 and 75 having their forward ends fixedly secured to the center rail 73. The rearwardly located ends 77 of rails 74 and 75 are fixedly connected to cross bar 81 in turn having opposite ends fixed mounted to flanges 78 and 79 pivotally mounted to the front rail 37 of frame 21. Thus, towbar assembly 26 may pivot upon its proximal ends positioning the longitudinal axis 48 (FIG. 3) of the towbar assembly relative to the longitudinal axis 28 of the frame a distance 49 and positioning the connector flange 80 for fastening to the truck hitch used to pull the vehicle frame device.

A plurality of downwardly extending brushes 82 (FIG. 4) are mounted to front rail 37. In addition, a plurality of brushes 83 are mounted to the rear rail 36 with the brushes extending downwardly from rails 36 and 37 and extending across the width of frame 21 and in addition outwardly thereof being mounted to wings pivotally mounted to frame 21.

Four brush wings 100-103 (Fig.1) are pivotally mounted to frame 21. In the drawings, wings 100 and 101 are shown in the downward position with the brushes attached thereto to engage the emulsion on the road surface, whereas wings 102 and 103 are shown in the upwardly stored position. Wings 102 and 103 are shown in the upward stored position simply to illustrate that the wings may be stored whereas both wings may be pivoted downward for the brushes attached thereto to engage the emulsion such as shown for wings 100 and 101. Likewise, wings 100 and 101 can be pivoted upward to the stored position as shown for wings 102 and 103.

Brush wing 101 will be now be described it being understood that a similar description applies to wings 100, 102, and 103. Wing 101 has rails 106 and 107 pivotally mounted by brackets 108 and 109 to frame 21. Bracket 108 pivotably mounts proximal end 110 of rail 106 to the front rail 36 whereas bracket 109 mounts the proximal end of wing rail 107 to side rail 35. Rails 106 and 107 have brushes 111 and 112 respectively mounted thereto which extend downwardly therefrom. The brushes may be removed by conventional fastening devices for replacement as needed. Wing rails 113 and 114 have their proximal ends attached respectively to brackets 115 and 116. The brackets, in turn, are mounted to the distal ends 117 and 118 respectively of rails 106 and 107. Brushes 120 and 121 are fixedly mounted to and extend downward from respectively rails 113 and 114. An end rail 122 joins the distal ends of rails 113 and 114 together with the rails 113 and 114 then extending divergently outward to the distal ends of rails 106 and 107. Rails 106 and 107 extend divergently outward from their distal ends towards their proximal ends 110. Thus, the wing frame composed of rails 106, 107, 113 and 114 has a generally V-shaped configuration with the outer portion of the wing consisting of rails 113 and 114 along with brushes 120 and 121 being pivotable relative to the inner portion of the wing frame formed by rails 106 and 107 which is also pivotable with respect to frame 21. A U-shaped handle 125 is fixedly secured to rail 106 to facilitate grasping and pivoting the wing upward.

Figure 5:
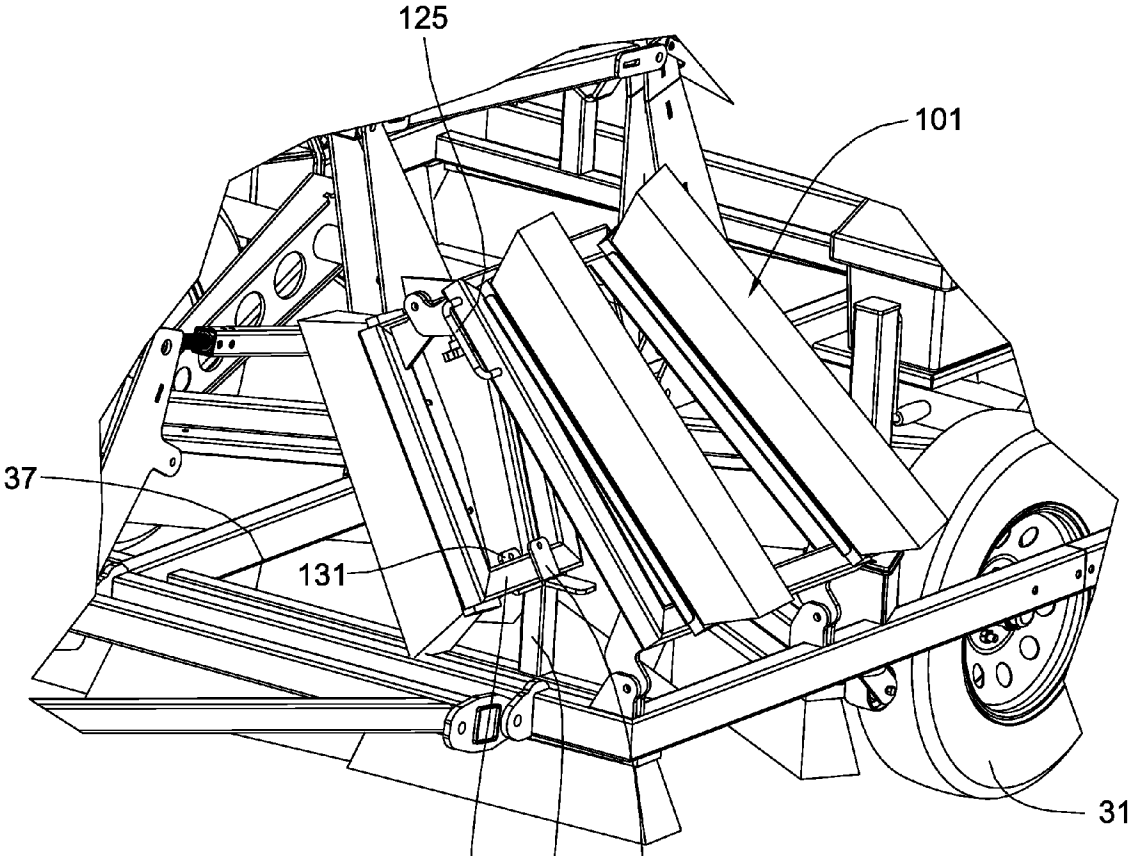
FIG. 5 is a fragmentary enlarged perspective of one of the wings and associated brush locked in the upward stored position.

The wing is shown in the stored position in FIG. 5. In order to store wing 101, the outer portion of the wing including rails 113 and 114 are pivoted upward with respect to rails 106 and 107 eventually causing rails 106 and 107 to pivot about brackets 108 and 109. An upstanding arm 130 has a pair of spaced apart walls 131 and 132 sized and spaced apart to receive end rail 122 of the wing which may be removably pinned thereto. In such a position, both inner and outer portions of the wing along with their associated rails 106, 107, 113 and 114 and attached brushes are stored in an upward position apart from the road surface. Similar upstanding arms are provided for wings 100, 102, and 103. Thus, the other three brush wings 100, 102, and 103 may be stored in an upward position allowing the brush frame and associated components to be stored in a more compact space. Likewise, depending upon the width of the road surface, the wings may be pivoted downward from the stored position to extend outward from frame 21 to engage the road surface. The brush wings on one side of the wing frame may be stored in the upward position while the remaining two brush wings on the opposite side of the wing frame may be located in the downward road engaging position and vice versa.

Figure 6:
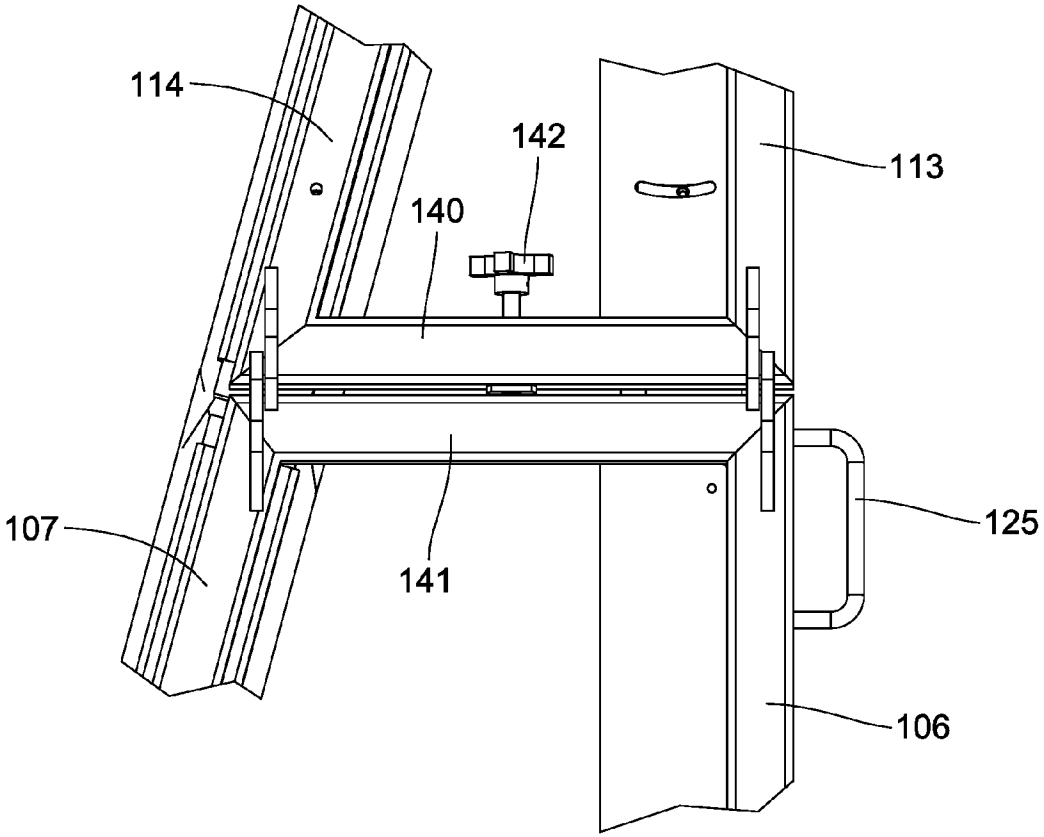
FIG. 6 is a fragmentary enlarged top view of one of the wings and associated brush with the distal end portion of the winged/brush positioned relative to the proximal end portion of the winged/brush by an adjustment screw.

Each wing 100-103 includes a manual adjustment screw rotatably mounted to the inner cross link of the outer portion of the wing with a screw distal end movable against the outer cross link of the inner portion of the wing to adjust the positioning of the outer wing portion to the inner wing portion. For example, wing 101 has a cross member 140 (FIG. 6) extending between and connected to the proximal ends of rails 113 and 114. Adjustment screw 142 is threadedly mounted to cross link 140 and has a distal end contactable against the outer cross link 141 extending between and connected to the distal ends of rails 106 and 107. In the event, the top road surface beneath brushes 120 and 121 is lower in elevation that the road surface beneath brushes 111 and 112 (FIG. 1), then adjustment screw 142 may be rotated until the outer brushes 120 and 121 drop lower in elevation than brushes 111 and 112 maintaining road surface contact with all of the brushes of wing 101.

Four adjustment jacks 150-153 (FIG. 1) are mounted inboard to frame 21 to provide easy transport of the device when the four wings 101-104 are in the upward stored position. Further, jacks 150-153 allow for the manual positioning of the frame relative to the road surface in order to allow for contact of the brushes on each side of the frame to maintain contact with the road surface. As the frame is pulled along an uneven surface, operators may walk along on both sides of the frame and manually adjust each jack to maintain the contact between the brushes and road surface.

Jack 150 will now be described, it being understood that a similar description to jacks 151-153. Jack 150 has a housing 158 (FIG. 3) mounted inward to frame 21 behind wheel 31. A crank 15 7 is operable when rotated to move a worm gear or rod 155 within housing 158 with the worm gear or rod 155 extending out of the bottom of casing 158 thereby raising or lowering a wheel 156 rotatably mounted to the bottom end of the worm gear or rod to engage the road surface. Alternatively, a shoe 161 may be mounted to the bottom of the worm gear as shown for jack 151. Any combination of wheels and shoes is used to allow the manual positioning of each side of the frame relative to the road surface and thus the contact between the brushes and the road surface.

Once the emulsion leveling device 20 is located atop the road, crank handle 85 is manually moved to rotate the worm gear 68 (FIG. 2) resulting in the vertical movement of the towbar assembly until towbar hitch plate 80 is positioned adjacent and connected to the hitch of the towing vehicle. Frame 21 remains horizontal atop the road as the towbar is moved angularly relative to frame until the hitch plate 80 is adjacent the towing vehicle hitch. Wings 100-103 are lowered in place to locate the wing brushes atop the road. Once the towbar is connected to the towing vehicle, further rotation of worm gear 68 results in a further change in the angle between axes 28 and 48 (FIG. 3) thereby enabling the operator to level the frame relative to the ground. During movement of worm gear 68, the linear actuator is locked in place and will not extend or retract.

With the worm gear 68 fixed in place, the linear actuator may be activated by transmitter 162 transmitting a signal to receiver 160 in turn activating actuator motor 166 to rotate the actuator worm gear causing extension or retraction of the actuator casing 56 (FIG. 1). Movement of the actuator results in pivoting movement of brackets 46 and 47 (FIG. 2) causing the axle to turn thereby raising wheels 30 and 31 to the upward stored position. During movement of the actuator, the manual worm gear 68 is fixed and does not extend or retract. Likewise, when the manual worm gear is extended or retracted, the actuator is fixed and does not extend or retract. As wheels 30 and 31 move upwardly, the various brushes contact the emulsion atop the road. The four jacks 150-153 are manually adjusted by workers walking to the side of frame 21 as the frame is pulled along the road. The handles on each jack enable the wheels/shoes located at the bottom of each jack to contact the road surface which may be lower than the crown of the road. Likewise, the adjustment screws 140 may be adjusted in the event there is a difference in elevation between the road and the brushes in each wing.

While the invention has been illustrated and described in detail in the drawings and foregoing description, the same is to be considered as illustrative and not restrictive in character, it being understood that only the preferred and alternate embodiments have been shown and described and that all changes and modifications that come within the spirit of the invention are desired to be protected.

What is claimed is:

1. A device for spreading and leveling emulsion applied to a road surface comprising:

a frame having a longitudinal axis of movement, a forward portion, a back portion, and opposite sides extending therebetween;

a towbar pivotally mounted to said forward portion of said frame;

a pair of wheels mounted to said frame with said axis extending therebetween;

plurality of brushes mounted to said frame and extending transversely across said axis of movement and extending downwardly to spread and level emulsion applied to a road surface;

a first mechanism connected to said towbar and said frame to pivot said towbar relative to said frame;

a source of electrical energy mounted on said frame; and, a second mechanism mounted on said frame and operatively connected to said source of electrical energy, said second mechanisms connected to said wheels for moving said wheels upwardly and downwardly relative to said frame positioning said brushes relative to the road surface.

2. The device of claim 1 and further comprising a transmitter to transmit command signals and a receiver to receive said signals, said receiver is mounted on said frame and is connected to said second mechanism to activate same.

3. The device of claim 2 wherein said transmitter is remote from said frame.

4. The device of claim 1 wherein said second mechanism includes a linear actuator and a first linkage connected to said wheels.

5. The device of claim 4 wherein:

said first mechanism includes a first bracket mounted to said towbar supporting said first mechanism and a second bracket pivotally mounted on said forward portion of said frame and connected to said first mechanism, said second mechanism includes a third bracket pivotally mounted to said back portion of said frame and connected to said wheels, and a link connecting said second bracket and said third bracket to pivot together.

6. The device of claim 5 and further comprising:

an axle extending across and rotatably mounted to frame, said pair of wheels rotatable mounted offset to said axle; and, wherein:

said second mechanism is connected to said third bracket for pivoting said third bracket and rotating said axle.

7. The device of claim 1 and further comprising:

a plurality of leveling jacks mounted to said opposite sides of said frame to manually move said opposite sides upwardly or downwardly to maintain contact of said brushes relative to the road surface across the width of the frame.

8. The device of claim 7 wherein:

said jacks each include a casing mounted to said frame with a rod within said casing which includes a bottom end with a road surface engaging roller whereas said top end includes a hand adjuster for moving said rod and roller upwardly and downwardly thereby moving said frame and brushes thereon relative to the road surface.

9. The device of claim 1 wherein:

said frame includes wings extending outwardly of said wheels with brushes mounted thereto; said wings are piviotably mounted to said frame allowing said wings with brushes to extend outwardly of said frame to engage the road surface or to pivot upwardly positioning and locking said wings with brushes inwardly of said wheels when not in use.

10. The device of claim 1 said wings each include an outer wing portion with brushes and an inner wing portion with brushes, said inner wing portion has a proximal end mounted to said frame and a distal end mountingly receiving said outer wing portion and further including an adjuster rotatably mounted to said outer wing portion and contactable with said inner wing portion to change the relative position of said outer wing portion relative to said inner wing portion.

11. A remote control leveler for use in leveling emulsion on a road surface comprising:

a frame having opposite sides and a longitudinal axis of movement located therebetween;

a plurality of brushes mounted on said frame to contact and level emulsion on a road surface as said brushes are moved along said axis of movement;

a towbar having a bar axis and connected to said frame, said bar axis extending from said axis of movement and arrangeable at an included angle therebetween;

an adjusting device connected to said towbar and said frame to adjust said included angle between said axis of movement and said bar axis;

wheels rotatably mounted on said frame;

a remote control transmitter to emit commands to raise and lower said wheels relative to said frame; and, a remote controlled receiver located on said frame operable to receive said commands to raise and lower said wheels relative to said frame thereby adjusting said brushes relative to said road surface.

12. The leveler of claim 11 wherein said, adjusting device includes a crank/worm gear mechanism to control height of said towbar for external connection.

13. The leveler of claim 12 wherein said towbar has a proximal end pivotally connected to said frame and a distal end for external connection, said towbar is pivotable to position said distal end to a position higher than said frame.

14. The leveler of claim 11 wherein said frame has pivotally mounted wings extending outwardly of said wheels and frame, said wings have some of said brushes thereon, said wings have a down position locating brushes mounted thereon outwardly of said wheels and an lockable up position locating brushes mounted thereon above said frame.

15. The leveler of claim 11 and further comprising a source of electrical energy mounted on said frame and connected to said receiver which is a linear actuator.

16. The leveler of claim 11 and further comprising leveling jacks mounted to said frame and having manually adjustable rollers contactable with the road surface to move said brushes to contact said road surface across said frame.

17. A machine to level an upwardly facing ground surface connectable to a hitch of a pulling vehicle comprising:

a frame;

brushes mounted to said frame and extending downwardly therefrom;

wheels rotatably mounted to said frame;

a towbar pivotably mounted to said frame for pulling said frame across an upwardly facing ground surface;

a first mechanism connected to said frame and said towbar for pivoting said towbar upwardly to align said towbar with the hitch of a pulling vehicle while said frame rests upon the ground surface;

a second mechanism mounted to said frame and connected to said wheels for moving said wheels upwardly from a ground engaging position whereat said brushes are spaced apart from the ground surface to an upwardly stored position whereat said brushes are in contact with the ground surface; and, a linkage arrangement connecting said first mechanism to said second mechanism and limiting relative motion therebetween.

18. The machine of claim 17 wherein:

said first mechanism includes a first bracket with a first bracket bottom end pivotably mounted to said frame;

said second mechanism includes a second bracket with a second bracket bottom end pivotably mounted to said frame, and, said linkage arrangement includes a link connecting said first bracket and said second bracket together limiting relative movement therebetween.

19. The machine of claim 18 wherein:

said first mechanism includes a worm gear/crank combination and said second mechanism includes a linear actuator.

20. The machine of claim 19 wherein:

said second mechanism includes:

axle rotatably mounted to said frame, arms fixedly mounted to said axle and movable therewith with said arms having said wheels rotatably mounted thereto offset from said axle, said second bracket bottom end is fixedly connected to said axle limiting relative motion therebetween, and, a remote control receiver connected to said linear actuator.

* * * * *